US007236098B1

(12) United States Patent
Kline et al.

(10) Patent No.: US 7,236,098 B1
(45) Date of Patent: Jun. 26, 2007

(54) FLOOR MOUNTED FLAT GRAPHIC DISPLAY WITH INTEGRAL ELECTROLUMINESCENT LAMP

(75) Inventors: Richard Kline, Grass Valley, CA (US); Rick A. Johnston, Cedar Ridge, CA (US); Matthew Wilkinson, Scotts Valley, CA (US); Don Mohle, Santa Cruz, CA (US); Frank Marshall, Nevada City, CA (US)

(73) Assignee: iGraphics, LLC, Grass Valley, CA (US)

( * ) Notice: Subject to any disclaimer, the term of this patent is extended or adjusted under 35 U.S.C. 154(b) by 518 days.

(21) Appl. No.: 10/186,308

(22) Filed: Jun. 28, 2002

Related U.S. Application Data

(63) Continuation of application No. 10/008,360, filed on Nov. 9, 2001, now abandoned, which is a continuation of application No. 09/828,327, filed on Apr. 5, 2001, now abandoned.

(60) Provisional application No. 60/194,917, filed on Apr. 5, 2000.

(51) Int. Cl.
*G08B 5/00* (2006.01)

(52) U.S. Cl. ..... 340/815.4; 340/815.65; 340/815.83; 340/691.6; 345/204; 345/107; 345/700

(58) Field of Classification Search ..... 315/149, 315/169.3; 455/90, 566; 340/815.4, 825, 340/691, 693, 541, 573.1, 815.65, 815.68, 340/332, 691.6, 825.72, 666; 345/76; 362/488; 704/270; 313/1, 498, 512, 49, 51, 506, 509; 15/215

See application file for complete search history.

(56) References Cited

U.S. PATENT DOCUMENTS

| | | | | |
|---|---|---|---|---|
| 4,125,653 | A * | 11/1978 | Muzik | 428/40.9 |
| 4,138,620 | A * | 2/1979 | Dickson | 313/1 |
| 4,791,258 | A * | 12/1988 | Youtz et al. | 200/302.1 |
| 5,434,013 | A * | 7/1995 | Fernandez | 428/690 |
| 5,533,289 | A * | 7/1996 | Hoffman | 40/544 |
| 5,621,991 | A * | 4/1997 | Gustafson | 40/544 |
| 5,631,805 | A * | 5/1997 | Bonsall | 361/681 |
| 5,814,947 | A * | 9/1998 | Brownell | 315/169.3 |
| 5,867,149 | A * | 2/1999 | Jaeger | 345/172 |
| 5,877,695 | A * | 3/1999 | Kubes et al. | 340/815.4 |
| 6,035,180 | A * | 3/2000 | Kubes et al. | 455/575.1 |
| 6,417,778 | B2 * | 7/2002 | Blum et al. | 340/815.4 |
| 6,464,381 | B2 * | 10/2002 | Anderson et al. | 362/488 |
| 6,498,620 | B2 * | 12/2002 | Schofield et al. | 348/148 |
| 2002/0026937 | A1 * | 3/2002 | Mault | 128/200.24 |
| 2002/0156634 | A1 * | 10/2002 | Blum et al. | 704/270 |

* cited by examiner

*Primary Examiner*—Tho Phan
*Assistant Examiner*—Chuc Tran
(74) *Attorney, Agent, or Firm*—Warner Norcross & Judd LLP

(57) ABSTRACT

Described is a floor mounted graphic display comprising an electroluminescent lamp assembly, a graphic overlay which is positioned over the electroluminescent lamp, a moisture barrier surrounding the electroluminescent lamp and the graphic overlay, a mounting plate which is incorporated into the electroluminescent lamp and the graphic overlay, a controller housing which is attached with the mounting plate and a controller which is situated in the controller housing.

9 Claims, 3 Drawing Sheets

FLOOR MOUNTED FLAT GRAPHIC DISPLAY WITH INTEGRAL ELECTROLUMINESCENT LAMP

This is a continuation of U.S. application Ser. No. 10/008,360, filed Nov. 9, 2001 now abandoned, which is a continuation of U.S. application Ser. No. 09/828,327, filed Apr. 5, 2001, now abandoned, which claims the benefit of U.S. Provisional Application No. 60/194,917, filed Apr. 5, 2000.

FIELD OF THE INVENTION

The present invention is directed to floor displays. More specifically it is directed to an electroluminescent floor display which incorporates an integrated controller and is designed to minimize wear and damage in normal environments. The floor graphic may be of any size shape color and may contain any type of electroluminescent lamp and overlay. The primary use of this type of display is for advertising but may be used in other applications such as equipment operation instructions, exit\entrance identification or hazard warnings.

Floor mounted graphic displays are previously known but these have suffered the problems associated with having a controller which is independent of the lamp display system. Ordinarily the displays have a strip of circuitry connecting the display assembly with the controller. As a result the displays have suffered damage from floor washing and other everyday activities.

SUMMARY OF THE INVENTION

The invention, in one embodiment, comprises an electroluminescent lamp assembly, which incorporates an electroluminescent lamp, a graphic overlay positioned over the electroluminescent lamp and, in a preferred embodiment, a moisture barrier surrounding the electroluminescent lamp and the graphic overlay. A mounting plate is incorporated into the electroluminescent lamp, the graphic overlay and the moisture barrier. In a preferred embodiment the mounting plate extends through the electroluminescent lamp, the graphic overlay and the moisture barrier and is attached with a controller housing. A controller is situated in the controller housing. The controller is connected with the electroluminescent lamp by means of a circuit and the circuit is primarily positioned within the perimeter of the moisture barrier.

BRIEF DESCRIPTION OF THE DRAWINGS

The invention will be better understood by reference to the appended figures, in which.

DETAILED DESCRIPTION OF THE INVENTION

The invention will now be described with reference to preferred embodiments and the appended figures.

Figure 1:
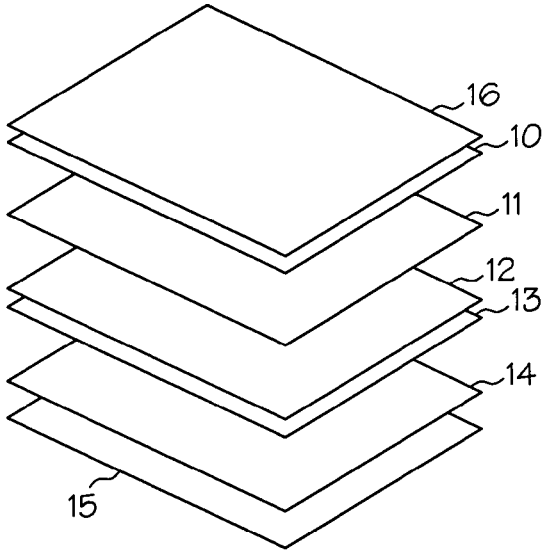
FIG. 1 shows one embodiment of the floor display.

FIG. 1 depicts one embodiment of the invention which comprises the following basic elements. Two or more elements may be combined into one layer. Graphic overlay layer 10 incorporates the advertising or other graphics to be illuminated, and creates the first stages of moisture resistance. Adhesive layer 11 adheres the graphic overlay to the electroluminescent lamp layer 13. Electroluminescent lamp layer 13 ordinarily incorporates a layer of indium tin oxide, making it a very good moisture barrier. Optional safety laminate layer 14 adheres to the lamp and guards against shock, protects conductive components, and is beginning of lower layer moisture barrier. A second adhesive layer adheres the safety laminate layer 14 to moisture barrier 15. Moisture barrier 15 protects against moisture migration and reduces moisture vapor transmission rate.

Figure 2:
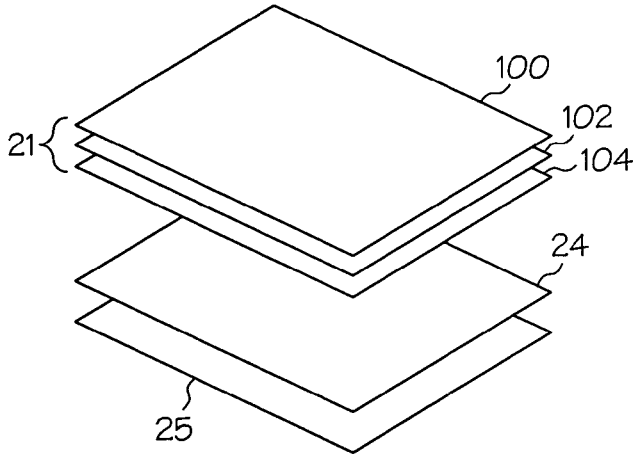
FIG. 2 shows a second embodiment of the floor display.

As an example, another embodiment of the floor graphic invention is shown in FIG. 2. The embodiment comprises the following elements. Graphic overlay with incorporated electroluminescent lamp layer 21 comprises the advertising graphics 102 to be illuminated as well as the illuminating electroluminescent lamp layer 104 and can include an upper moisture barrier 100. Safety laminate 24 is adhered to the graphic overlay electroluminescent lamp layer 21 and guards against shock, protects conductive components and aids in moisture resistance. Adhesive adheres safety laminate 24 to lower moisture barrier 25. Lower moisture barrier 25 protects against moisture migration and reduces moisture vapor transmission rate.

Figure 3:
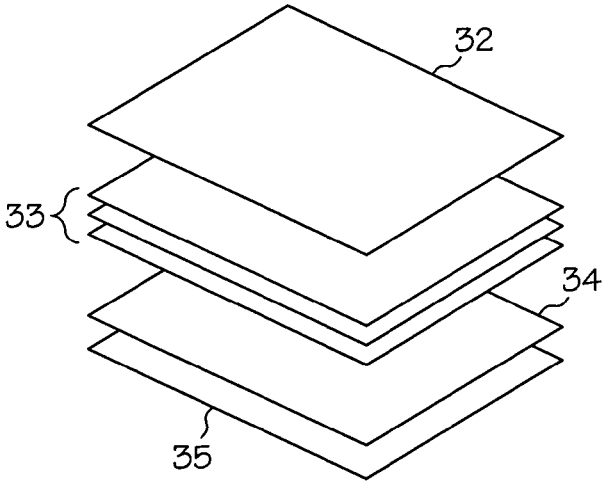
FIG. 3 shows a third embodiment of the floor display.

As a further example, another embodiment of the invention is shown in FIG. 3 and comprises the following elements. Clear vinyl overlaminate layer 32 comprises a textured material to protect the lamp and graphics, and to improve moisture resistance. Adhesive laminates the clear vinyl overlaminate to the graphic overlay with incorporated lamp 33 The safety laminate layer 34 is adhered to or otherwise attached with the graphic overlay with incorporated lamp and guards against shock, protects conductive components, and aids in moisture resistance. Adhesive adheres safety laminate 34 to moisture barrier 35. Moisture barrier 35 protects against moisture migration. and reduces moisture vapor transmission rate.

Figure 4:
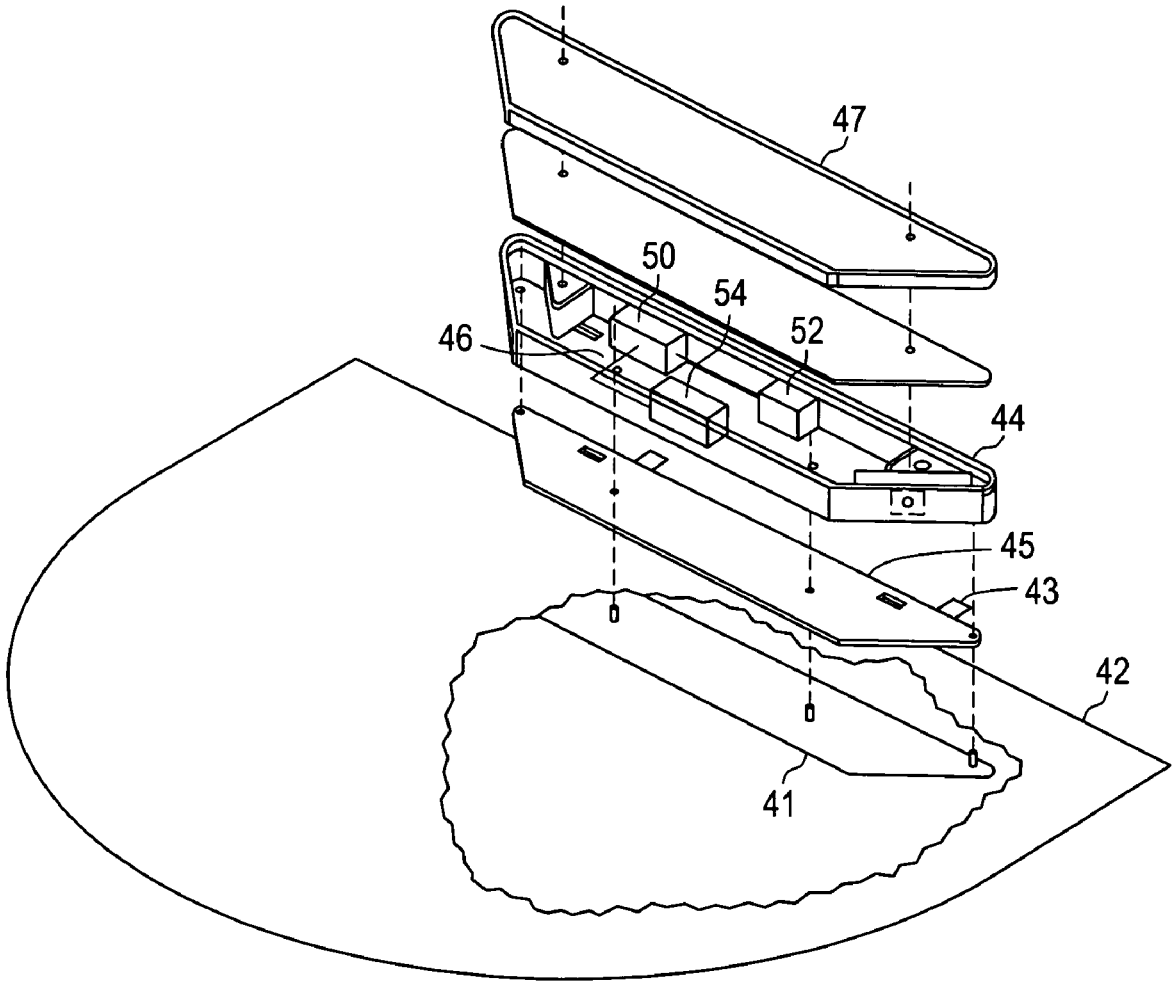
FIG. 4 shows the integrated controller of on embodiment of the present invention.

FIG. 4 shows the integrated controller of the present invention. In this embodiment mounting plate 41 is incorporated into graphic and electroluminescent lamp layer 42. Electroluminescent circuit ends 43 protrude slightly from controller housing 44. An optional moisture barrier 45 is included in the controller housing 44. An optional battery holder 46 is included in housing 44. Lid 47 closes off housing 44 and provides moisture protection.

Controller 50 is contained within housing 44. Power supply 52 is also contained within housing 44. Power supply 52 could be a battery or could be a power supply adapted to be connected to a source of AC power. Motion sensor 54 is attached to the housing 44.

Figure 5:
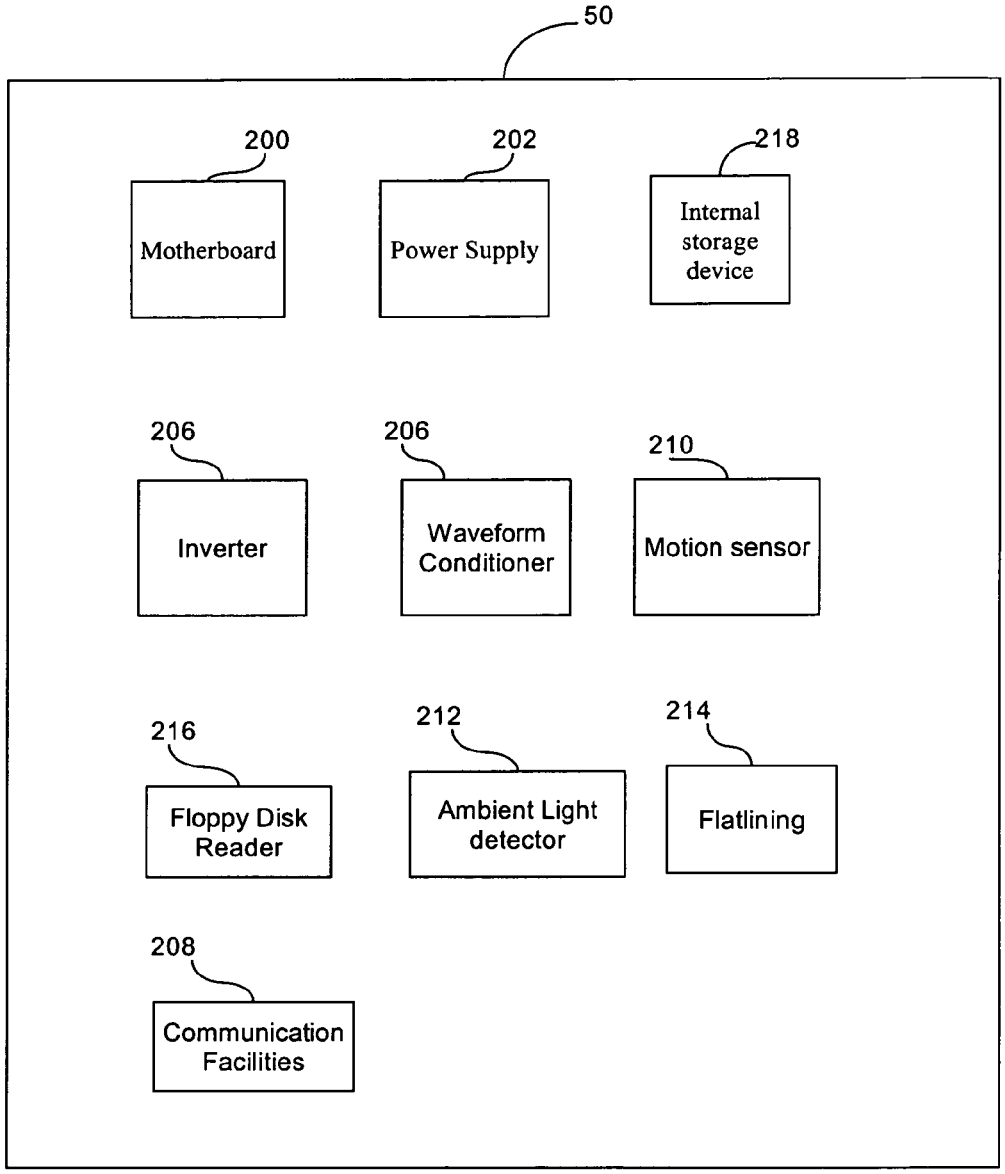
FIG. 5 is a block diagram of the controller.

In previous embodiments, the controller assembly operated from a separate, remote location near available AC power, situated up off the floor so as to be less susceptible to moisture. This remote controller was connected to the lamp tail via an exposed and vulnerable ribbon cable. In one embodiment, the controller of the present invention remedies many known controller problems by substituting a remotely programmable computer in place of the microprocessor. This computer, called the motherboard, allows the controller to generically control any electroluminescent display system, and it permits the controller to be immediately reusable, without movement, for any subsequent display. The motherboard is remotely programmable either by a series of instructions that is carried on board (by various means) the display system itself, or by instructions that are downloaded into the controller from a wireless device and/or a telephonic connection. FIG. 5 shows a block diagram of controller 50. In this embodiment the controller contains a motherboard 200, a power supply 202, and various inverters 204 and waveform conditioners 206. It may also contain inbound/outbound communications facilities 208, motion sensing apparatus 210, ambient lighting detection 212, scanning/flatlining techniques 214, a floppy disk reader 216 and internal storage devices 218.

The controller assembly of the present invention has a water-resistant housing. This allows the controller to better withstand the cleaning processes found in most typical installation environments. In another unique controller design change the controller housing has been incorporated into the overall lamp and graphic assembly via a "mounting plate" that comes up through the lamp\graphics and controller housing and is secured together as one assembly. This entire assembled unit is then adhered to the floor as one piece. This adds great structural integrity to the entire unit when mounted. The new controller configuration has been adapted to accept batteries and or typical AC power. Also added to the controller has been the incorporation of "motion sensors" which increase the useful life of the batteries as well as the lamp life. The motion sensor also creates an element of surprise, by what would appear to be a random commencement of the light animation cycle.

The new integral design of the "lamp circuit ends" (tail section) makes the tail section more secure by incorporating it inside of the lamp perimeter rather than completely protruding off the edge. By protecting the tail-electronics connection within the waterproof controller assembly and eliminating the long ribbon cable, we have eliminated the tail's susceptibility to structural stress and moisture.

In one embodiment the moisture barrier is composed of vinyl. In a preferred embodiment the moisture barrier is composed of metalized polypropylene. In another preferred embodiment the moisture barrier is composed of a layer construction of polyesters with metalized coatings. In a most preferred embodiment a metalized polyester layer is positioned between layers of permanent and removable adhesives.

The lamp graphics and controller module are assembled as one unit and are secured together which increases the overall structural integrity of the product increases the protection of the circuitry connecting the controller with the electroluminescent lamp assembly.

In one embodiment the graphics are printed on the face of a heat stabilized indium tin oxide polyester. The complete lamp is then printed on the reverse side or the conductive indium tin oxide side of the printed graphics in the chosen areas to be illuminated, eliminating the separate graphic layer. The product is completed with a safety laminate, adhesive\moisture barrier, and a clear vinyl overlaminate on the viewing side of the product.

Optionally the circuitry tail connecting the controller with the electroluminescent lamp can be incorporated into the perimeter of the moisture barrier rather than protruding from the end of the assembly. The new design configures the circuitry tail into the graphics and it is then incorporated into the controller housing when assembled. This adds overall structural integrity to the completed product and protects the circuitry tail making it less vulnerable to damage. In one embodiment the controllers are encased in a water-resistant housing which enhances durability. Incorporating the Graphics and Lamp adds structural integrity. Motion sensors adds effective life to the batteries and lamp In addition the new controller design improves battery life and accepts touch switch input, initiating audio output. In one embodiment the touch switch actuations are counted and reported to service personnel.

Although the description above contains the details of preferred embodiments, these should not be construed as limiting the scope of the invention, but as merely illustrative of the invention. Indeed, variations of the invention will be readily apparent to those skilled in the art and also fall within the scope of the invention. Thus the appended claims and their legal equivalents should determine the scope of the invention.

We claim:

1. A floor mounted graphic display comprising:

an electroluminescent lamp layer;

a graphic overlay positioned over the electroluminescent lamp layer so that the graphic overlay is illuminated by the electroluminescent lamp layer;

an upper moisture barrier positioned above the electroluminescent lamp layer;

a mounting plate attached to the electroluminescent lamp layer;

a controller housing attached with the mounting plate to the electroluminescent lamp layer; and a controller situated in the controller housing.

2. The floor mounted graphic display of claim 1 wherein the controller is connected with the electroluminescent lamp layer within the perimeter of the moisture barrier.

3. The floor mounted graphic display of claim 2, wherein the controller is powered by either battery or AC power.

4. The floor mounted graphic display of claim 3 further comprising a motion sensor.

5. The floor mounted graphic display of claim 4, wherein the controller housing is waterproof.

6. The floor mounted graphic display of claim 5 wherein the electroluminescent lamp layer is surrounded by the upper moisture barrier and a lower moisture barrier.

7. The floor mounted graphic display of claim 4 where the controller includes a motherboard.

8. The floor mounted graphic display of claim 4 where the controller includes an inverter.

9. The floor mounted graphic display of claim 4 where the controller includes an internal storage device.

* * * * *